US006453918B2

(12) United States Patent
Cardemon

(10) Patent No.: US 6,453,918 B2
(45) **Date of Patent: *Sep. 24, 2002**

(54) SAFETY AND ENVIRONMENTAL WORKBENCH

(75) Inventor: Richard A. Cardemon, Muncie, IN (US)

(73) Assignee: Car-Tec Company, Muncie, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/789,037

(22) Filed: Feb. 20, 2001

Related U.S. Application Data

(63) Continuation of application No. 09/116,630, filed on Jul. 16, 1998, now Pat. No. 6,202,657.

(51) Int. Cl.[7] ..... B08B 3/02

(52) U.S. Cl. ..... 134/135; 134/153; 134/148; 134/200

(58) Field of Search ..... 134/49, 52, 104.2, 134/119, 120, 121, 134, 135, 137, 149, 151, 198, 153, 147, 148, 157, 200, 101; 248/399.1; 118/82, 84, 398; 451/319, 318, 320; 15/77, 88.3, 102

(56) References Cited

U.S. PATENT DOCUMENTS 1,244,213 A 10/1917 Hunt
1,350,403 A 8/1920 Chase ..... 15/88.3
1,673,910 A 6/1928 Gipe
2,127,778 A * 8/1938 Lewis
2,394,338 A 2/1946 Stine ..... 15/21
2,411,174 A 11/1946 Swensen et al. ..... 259/49
2,614,316 A 10/1952 Dailey et al. ..... 29/81
2,668,091 A * 2/1954 Clark
2,824,029 A 2/1958 Zinty ..... 134/23
2,903,002 A 9/1959 Adkins ..... 134/161

(List continued on next page.)

6,095,165 A * 8/2000 Mastronardi

OTHER PUBLICATIONS

Brochure from Noise Reduction Products, Inc. (NRP) for NRP's Model A 1 "Blow–Off Box." Noise Reduction Products, Inc., Alstead, NH.

*Primary Examiner*—Frankie L. Stinson
(74) *Attorney, Agent, or Firm*—Woodard, Emhardt, Naughton, Moriarty & McNett

(57) ABSTRACT

A workbench including provisions for cleaning of an object. The workbench includes an enclosure and a shelf that is slidable into and out of the enclosure. The shelf can support an object within the enclosure. A manifold and nozzles within the enclosure direct cleaning liquid or compressed gas at the object so as to clean it and collect the material removed from the object within the enclosure. The workbench includes a top suitable for dimensional gaging and inspection of the object.

21 Claims, 9 Drawing Sheets

U.S. PATENT DOCUMENTS

| | | | | | |
|---|---|---|---|---|---|
| 3,133,547 | A | * | 5/1964 | Dannenmann et al. | |
| 3,447,543 | A | * | 6/1969 | Till | |
| 3,645,791 | A | | 2/1972 | Sadwith | 134/25 A |
| 4,052,227 | A | | 10/1977 | Delo et al. | 134/56 R |
| 4,066,117 | A | | 1/1978 | Clark et al. | 164/46 |
| 4,191,437 | A | | 3/1980 | Funke | 312/305 |
| 4,398,492 | A | | 8/1983 | Casey | 118/105 |
| RE31,792 | E | * | 1/1985 | Colmer | |
| 4,641,671 | A | | 2/1987 | Nogi et al. | 134/57 D |
| 4,740,248 | A | | 4/1988 | Thro et al. | 134/21 |
| 4,744,379 | A | | 5/1988 | Goettel | 134/109 |
| 4,924,801 | A | | 5/1990 | Arnone | 118/58 |
| 4,928,440 | A | | 5/1990 | Hughes | 51/426 |
| 4,998,742 | A | | 3/1991 | Maynard | 280/35 |
| 5,423,651 | A | | 6/1995 | Dinverno | 414/500 |
| 5,533,799 | A | | 7/1996 | Nickolaus, Jr. | 312/249.12 |
| 5,546,629 | A | | 8/1996 | Shim | 15/302 |
| 5,551,773 | A | | 9/1996 | Cottrell | 312/249.8 |
| 5,558,112 | A | | 9/1996 | Strieter | 134/103.2 |
| 5,562,114 | A | | 10/1996 | St. Martin | 134/111 |
| 5,562,531 | A | | 10/1996 | Yamaharu | 451/88 |
| 5,582,225 | A | | 12/1996 | Schank | 144/286 |
| 5,588,376 | A | | 12/1996 | Seidl et al. | 108/106 |
| 5,592,981 | A | | 1/1997 | Derecktor | 144/286 |
| 5,631,894 | A | | 5/1997 | Takahashi | 369/270 |
| 5,640,981 | A | | 6/1997 | Niemela et al. | 134/114 |
| 5,697,839 | A | | 12/1997 | Chen et al. | 454/67 |
| 5,722,443 | A | | 3/1998 | Marler et al. | 134/114 |
| 5,782,252 | A | | 7/1998 | Lewis et al. | 134/148 |

* cited by examiner

SAFETY AND ENVIRONMENTAL WORKBENCH

This application is a continuation of and claims priority to U.S. patent application Ser. No. 09/116,630, filed Jul. 16, 1998 now U.S. Pat. No. 6,202,657, which is incorporated here and by reference.

BACKGROUND OF THE INVENTION

The present invention relates to workbenches, especially those workbenches that incorporate features for cleaning of objects.

Machining and processing of an object often involves exposing the object to various materials, including cutting oils, lubricating oils, marking chemicals, penetrating inspection dyes, and other chemicals. Also, the machining and handling of the object often results in the adherence of chips, dust, dirt, and other particles to the surface of the object.

In order to accurately measure the dimensions and inspect the surfaces of the object, it is necessary to first remove these materials from the object. Often this removal is performed on top of a working surface, with the operator blowing compressed air or a cleaning liquid at the object such that the material is removed from the object but deposited in the surrounding work area. In some instances the cleaning liquid is sprayed out and not easily collected and removed from the work area for subsequent disposal. Further, the removal is often performed in a cleaning area separate from the area in which the object is measured and inspected. Subsequent to the removal, there is time lost and cost incurred in moving the object to the measuring and inspection area. Further problems with the use of high velocity air or cleaning liquid include the possibility of the material causing an eye injury to the operator, or the possibility of the operator slipping on a wet floor.

What is needed is an invention that overcomes the shortcomings of the related art. The present invention does this in a novel and unobvious way.

SUMMARY OF THE INVENTION

Briefly describing one aspect of the present invention, there is provided an apparatus for cleaning an object comprising an enclosure with a bottom and a plurality of sides, and a plurality of legs to support the enclosure. There is also provided a shelf slidable within the enclosure for supporting the object to be cleaned, the shelf having an outer position. The apparatus further includes means for directing a flow of liquid at the object, and a collector on one side of the enclosure positioned to collect liquid from the object when the shelf is in the outer position and to direct the collected liquid to the bottom of the enclosure.

Briefly describing another aspect of the present invention, there is provided an apparatus comprising an enclosure with a plurality of sides and a plurality of legs to support the enclosure. A table top is attached to the enclosure. There is also a shelf lower than the table top, the shelf being positionable within the enclosure. The apparatus also includes means for raising and lowering the shelf within the enclosure, and at least one nozzle within the enclosure for providing a flow of gas or liquid at the part.

Briefly describing another embodiment of the present invention, there is provided an apparatus comprising an enclosure with a plurality of sides and a plurality of legs supporting the enclosure. A table top is attached to the enclosure. There is a shelf slidable within the enclosure, the shelf having an inner position in which a portion of the shelf is under the table top. The apparatus also includes a plurality of nozzles within the enclosure for directing a flow of gas or liquid at the shelf in the inner position.

Briefly describing another aspect of the present invention, there is provided an apparatus for cleaning an object comprising an enclosure and a plurality of sides, one of the sides defining an opening. A shelf is slidable through the opening into the enclosure. A brush seal is attached to one side and at least partially obstructs a portion of the opening, stopping droplets, chips, debris and other material from hitting the operator. The brush is useful for brushing the object. The apparatus also includes a table top attached to the enclosure, the table top being suitable for gaging the object.

It is an object of the present invention to provide an improved apparatus for cleaning an object at a workbench.

This and other objects and advantages will be apparent from the description of the preferred embodiment, the drawings, and the claims to follow.

DESCRIPTION OF THE PREFERRED EMBODIMENT

Figure 1:
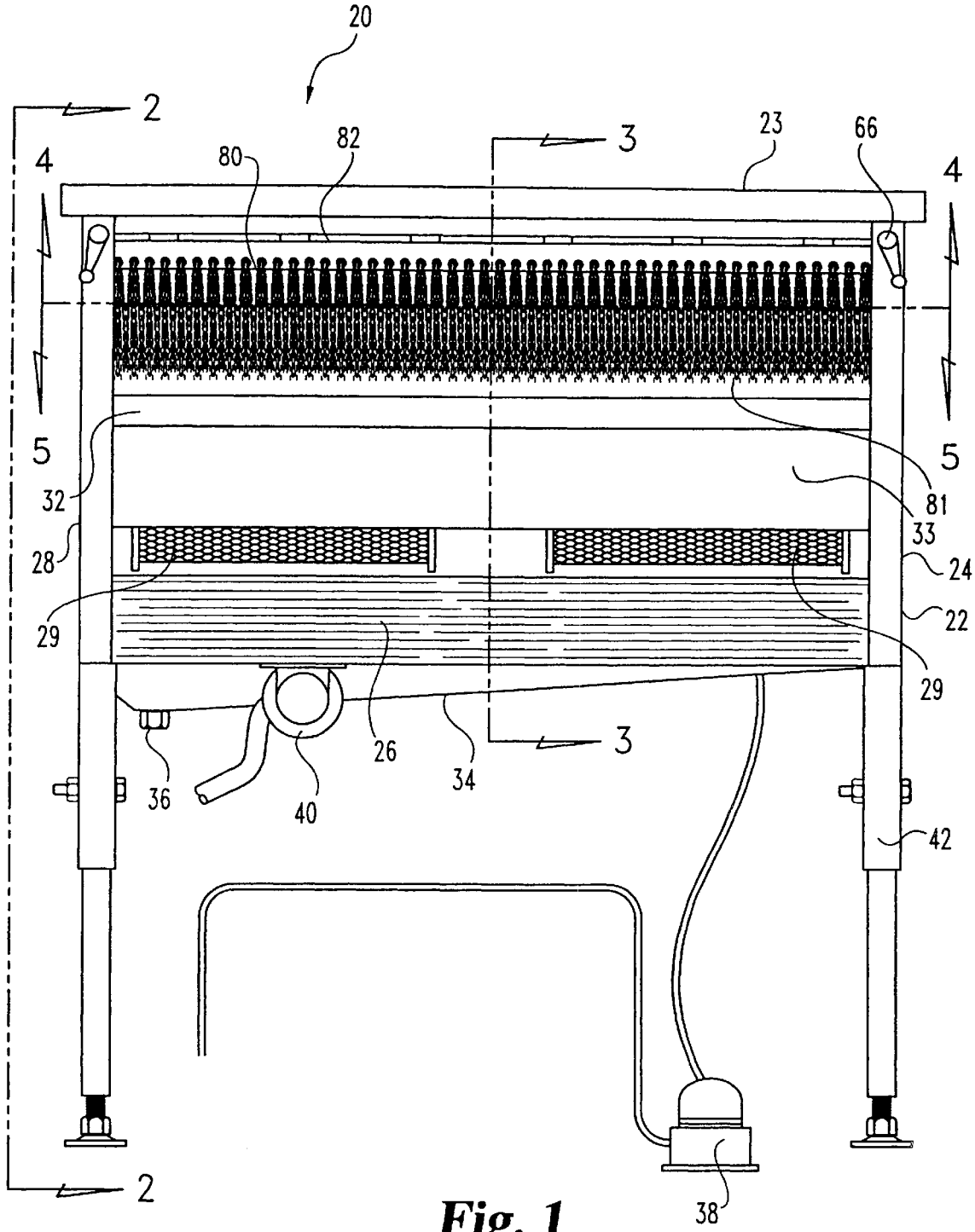
FIG. 1 is a front elevational view of a workbench according to one embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

The present invention relates to a multi-purpose workbench. One embodiment of the present invention includes a workbench suitable for cleaning oil, residue, chips, and other material from an object, such as an object that has been machined but not cleaned after machining.

In one embodiment, the present invention includes an enclosure with sides, and a shelf that is slidable into and out of the enclosure. The object needing to be cleaned can be placed on the shelf when the shelf is slid to a first, extended, outer position. The shelf and part can then be slid into the enclosure.

The shelf and part can be slid to a second, retracted inner position in which the object and at least a portion of the shelf are under the top of the enclosure. The operator can then actuate a plurality of nozzles within the enclosure that direct a flow of air and/or liquid at the object on the shelf so as to clean and blow off any chips, residue, liquid or other contaminants on the object. The material that is cleaned from the object drops into the bottom of the enclosure. The mixture of cleaning liquid and material removed from the object collects in the bottom where it may be removed and, if desired, filtered and separated so as to minimize environmental impact.

In one embodiment, the present invention also includes air-blast nozzles so as to direct a flow of high velocity air at the object to be cleaned. This air blast assists in removing chips and dirt from the object. The released air exits the enclosure from a screened area incorporated into one or more of the sides of the enclosure. The screen permits the air to be exhausted with minimal restriction, and prevents escape of the chips from the enclosure. The chips and dirt removed from the part are captured within the enclosure and do not escape into the surrounding work area, or strike the operator.

In another embodiment of the present invention, a side of the enclosure incorporates a collector to keep cleaning liquid or other material from being deposited on the floor around the workbench. The collector is positioned underneath the shelf when it is slid to the outer position. Liquid dripping from the shelf and the object when the shelf is in the outer position is collected within the collector and directed to the bottom of the enclosure.

In another embodiment of the present invention, there is provided a means for raising and lowering the shelf within the enclosure. The shelf can be lowered and slid to the outer position by an operator. The operator can place the object on the shelf, slide the shelf to the inner position within the enclosure, and then raise the shelf to a position within the enclosure proximate one or more nozzles within the enclosure that provide a flow of air and/or cleaning liquid onto the shelf and the object. By placing the shelf proximate to the one or more nozzles, the object to be cleaned is exposed to high velocity air and/or liquid for improved cleaning of the object. Means for raising and lowering the shelf include: hydraulic actuators such as hydraulic cylinders; pneumatic actuators such as pneumatic cylinders; hand-cranks operating gears and/or pulleys; electrical actuators including geared electric motors and electric motor-actuated ball screw devices; and equivalent devices known to those of ordinary skill in the art.

One embodiment of the present invention also includes a table top attached to the enclosure. The table top is suitable for gaging, measuring and inspection of dimensions, surface features, and other aspects of parts. In a preferred embodiment of the present invention, the table top is a smooth wooden table top.

Figure 2:
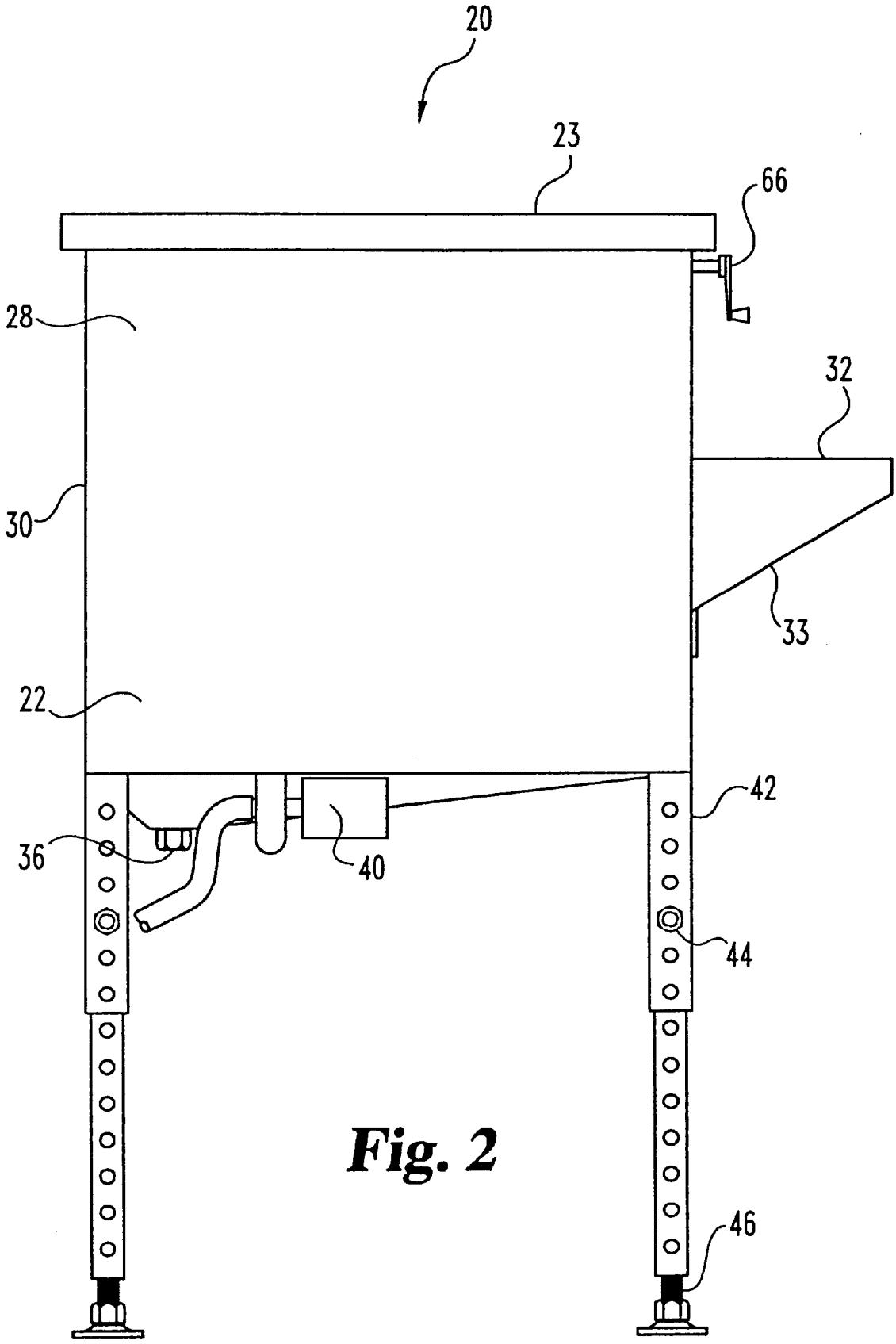
FIG. 2 is a side elevational view of the apparatus of FIG. 1 as taken along line 2—2 of FIG. 1.

FIGS. 1 and 2 depict an external configuration of one embodiment of the present invention. The workbench 20 includes an enclosure 22 supporting a top 23. Enclosure 22 includes sides 24, 26, 28, and 30. Side 26 incorporates a collector 32 that collects liquid and other material falling from the object being cleaned and directs the collected liquid or material to a bottom 34 of workbench 20. Collector 32 includes a bottom surface 33 shaped so as to direct the flow of the collected material toward bottom 34. Side 33 of collector 32 is preferably angled downward and inward, but may also be rounded or of some other similar shape suitable for directing collected material to bottom 34.

Bottom 34 collects all liquid and material falling off of the object to be cleaned and is shaped so as to have a low collection point. Preferably located at this low collection point is a drain 36 from which the collected liquid and material may be removed from workbench 20. Bottom 34 or drain 36 may incorporate a filter (not shown) so as to separate solid material from the liquid material being removed through drain 36.

Top 23 of workbench 20 is preferably a smooth surface suitable for dimensional gaging of the object. Top 23 is preferably a hard, wooden top, but may also be constructed from other materials suitable to support the part and the gaging, including by way of example, metal or slate.

Some embodiments of the present invention also include components suitable for preparing and delivering the air and/or liquid to be used in cleaning the object. For example, a pump 40 may be used to increase the pressure of the air or liquid. Also, a foot control 38 is preferably included to control the delivery of the air or liquid. In some embodiments of the present invention, there may be separate foot controls and/or hand controls for delivery of air and liquid.

Enclosure 22 is preferably supported by a plurality of legs 42. Legs 42 are preferably adjustable, including adjustment features 44 for adjusting the overall height of workbench 20, and leveling adjustment features 46 for establishing a level position of top 23.

Figure 3:
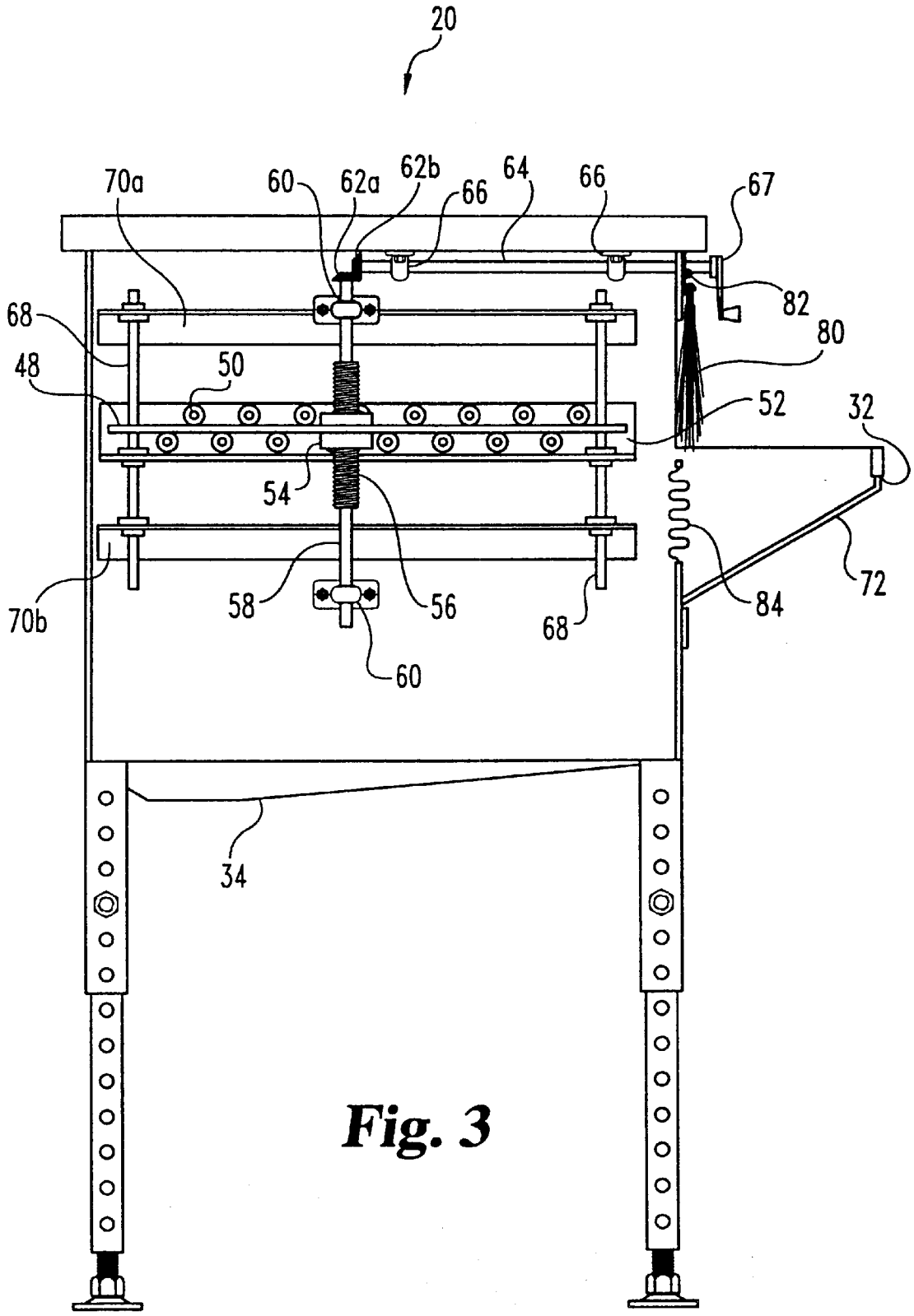
FIG. 3 is a cross-sectional view of the apparatus of FIG. 1 as taken along line 3—3 of FIG. 1.
Figure 5:
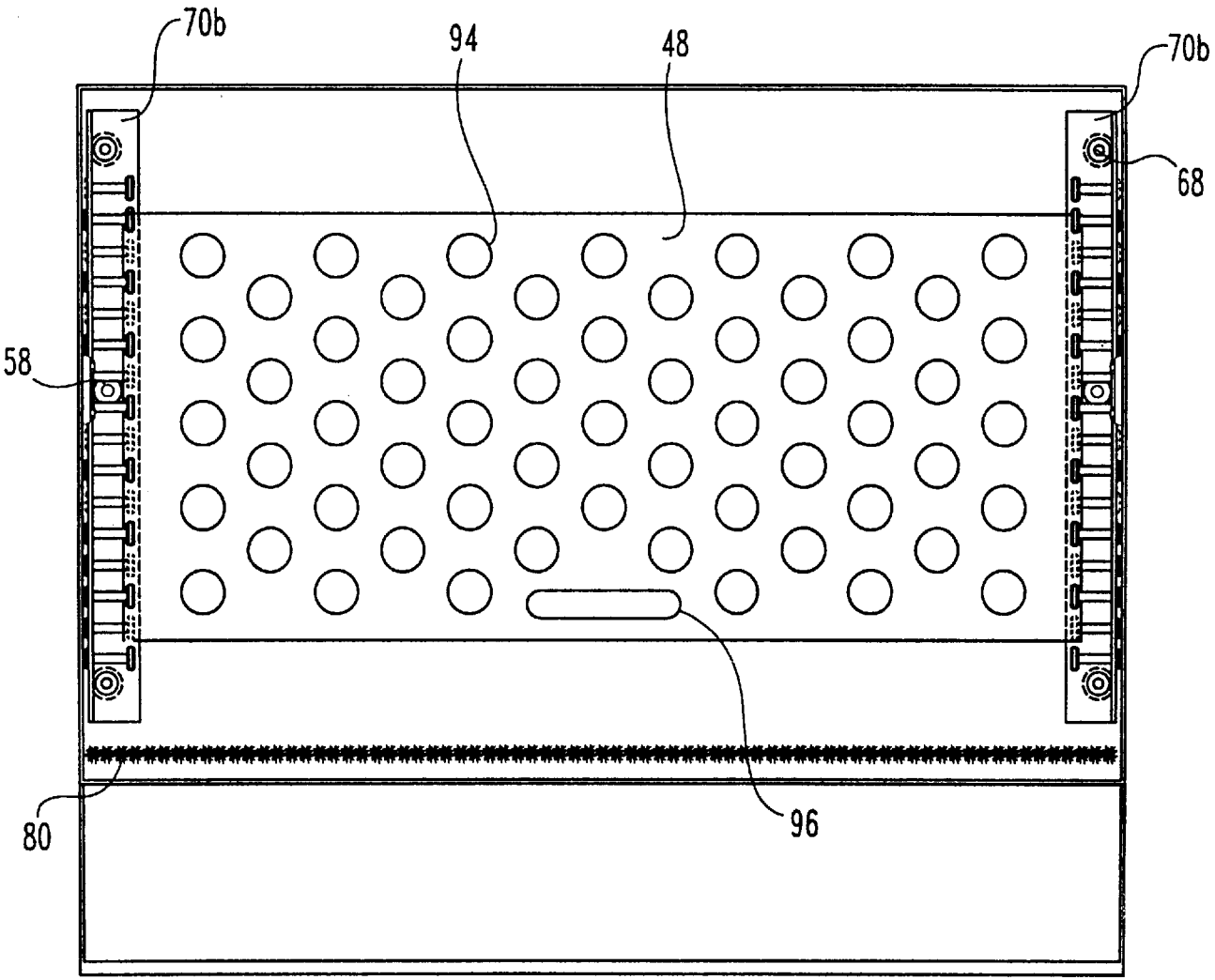
FIG. 5 is a cross-sectional view of the apparatus of FIG. 1 as taken along line 5—5 of FIG. 1.

FIG. 3 depicts a shelf 48 positioned within enclosure 22. Shelf 48 is preferably slidably supported between rollers 50 rotatably attached to a shelf support 52. Shelf 48 is preferably slidable from an inner position in which a portion of the shelf is under table top 23, to an outer position (not shown). In the outer position, a portion of shelf 48 is located above side 33 of collector 32. Referring to FIG. 5, shelf 48 includes a plurality of perforations 94 that permit cleaning liquid and material to drop through shelf 48 and drop onto bottom 34 of workbench 23. Shelf 48 also includes a handle 96 by which an operator may move shelf 48 between the inner and outer positions.

In one embodiment of the present invention, shelf support 52 may be raised and lowered within enclosure 22. FIG. 3 depicts a portion of a means for raising and lowering shelf support 52. The various manifolds and nozzles are omitted from FIG. 3 for sake of clarity. Shelf support 52 includes an internally threaded collar 54 that is threadably coupled to an externally threaded screw portion 56 of a rotatable first rod 58. Rotation of rod 58 acts through collar 54 and screw 56 to raise and lower shelf support 52 and thus shelf 48. Rod 58 is supported by a pair of bearings 60. One end of rod 58 includes a gear **62*a* in mesh with another gear 62*b* located on one end of a second rod 64. Rod 64 is supported by a pair of bearings 66. The other end of rod 64 includes a hand crank 67 or a similar device for manual turning of rod 64. Rotation of hand crank 67 best results in rotation of rod 58 and raising or lowering of shelf 48. Shelf support 52 is guided within enclosure 22 by means for guiding shelf 48, which in one embodiment comprises a pair of stationery guide rods 68 which are supported by top and bottom rod supports 70*a* and 70*b***, respectively.

Figure 6:
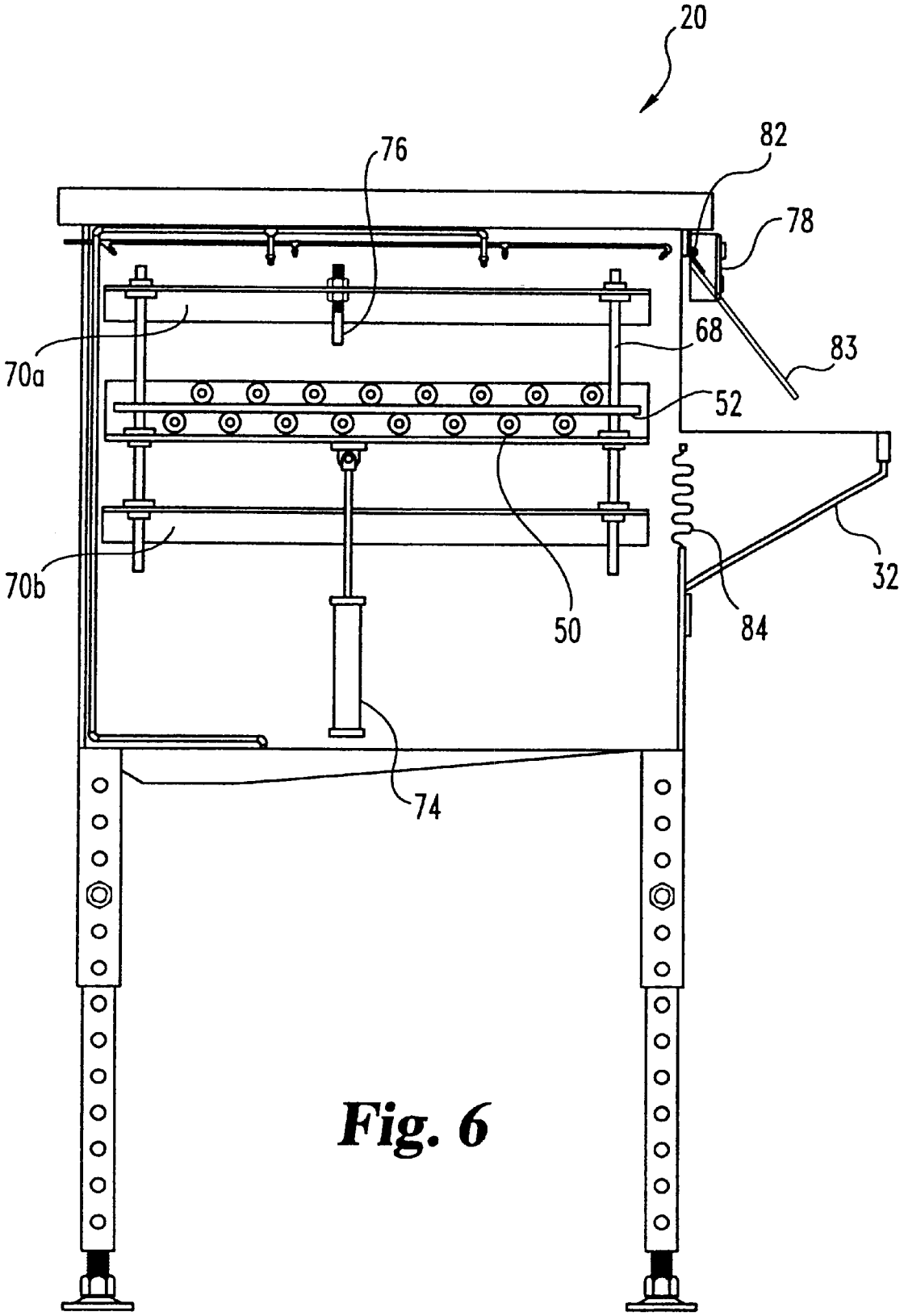
FIG. 6 is a cross-sectional view of the workbench according to another embodiment of the present invention.

An alternative means for raising and lowering the shelf is shown in FIG. 6. A hydraulic or pneumatic actuator 74 is preferably pivotally coupled to shelf support 52. A travel stop 76 is preferably incorporated into either top guide rod support **70*a* or bottom guide rod support 70*b*. One or more control buttons 78 control supply of pressurized hydraulic fluid or compressed gas through a valve (not shown) to actuator 74. In one embodiment providing pressurized fluid to actuator 74 causes actuator 74 to raise shelf 48 until shelf 48 comes into contact with the end of travel stop 76**.

Subsequent releasing of pressure within actuator 74 causes shelf 48 to lower within enclosure 22 under its own weight, or in some embodiments, as a result of a spring return (not shown) within actuator 74.

Although two embodiments of the means for raising and lowering shelf 48 have been shown and described, there are numerous alternative means for raising and lowering. For example, an electric motor (not shown) external to enclosure 22 can turn a gear in contact with gear 62*a* so as to rotate rod 58. As another example, hand crank 67 can also be used to turn an arrangement of belts and pulleys or toothed belts and gears readily adaptable to the present invention, as known to those of ordinary skill in the art. As another example, various other mechanisms may be substituted for the guiding means including guide rods previously described. Alternative guiding mechanisms include by way of example, an arrangement of vertical slots in or mounted to enclosure 22 for guiding shelf-edge features. FIGS. 3 and 6 depict the shelf raising and lowering means positioned along side 24 of enclosure 22. It is preferable that there be shelf-raising and lowering means also located on side 28 of enclosure 22 (not shown). However, the present invention also includes those embodiments in which the guiding means are located on opposite sides of enclosure 22, and the raising and lowering means is centrally located within the enclosure. For example, a single hydraulic actuator or pneumatic actuator may be centrally located along shelf 48 and act upon a centrally located shelf support.

Referring now to FIGS. 1, 3 and 6, one embodiment of the present invention includes a hingeable brush seal 80. Brush seal 80 preferably include thin, rigid nylon bristles, but may also be fabricated from other types of suitable brushing materials. Brush seal 80 is arrayed so as to generally cover a horizontal opening 81 defined along side 26 of enclosure 22 and generally above collector 32. Brush seal 80 reduce the escape of cleaning liquid or other material from within enclosure 22, yet still permit release and diffusion of gas discharged from the gas blast nozzle. Brush seal 80 in one embodiment is supported from the top of side 22 by a hinge 82. In this particular embodiment, brush seal 80 may be hinged outward and upward so as to allow more access room to load and remove parts from shelf 48. Hinged brush seal 80 may also be locked in the downward or upward position so that brush seal 80 may be used as a brush. Brush seal 80 have sufficient rigidity and stiffness for removal of chips from the object to be cleaned. As the operator loads the object onto shelf 48, the operator can work the object against the edge of brush seal 80 to loosen material that may be adhered to the object. As an alternative to brush seal 80, the present invention also contemplates the use of a clear , semi rigid sprayshield 83 as shown in FIG. 6.

Cooperating with brush seal 80 to reduce the exiting of sprayed liquid cleaner or other material from workbench 20 is a flexible spring-loaded bellows seal 84. The edges of sealing bellows 84 are guided by enclosure 22 (not shown) and are spring-loaded so as to urge the top edge of bellows seal 84 toward the free end of brush seal 80. Bellows seal 84 may be pushed downward by the operator when repositioning shelf 48 and loading and unloading parts from shelf 48.

Figure 4:
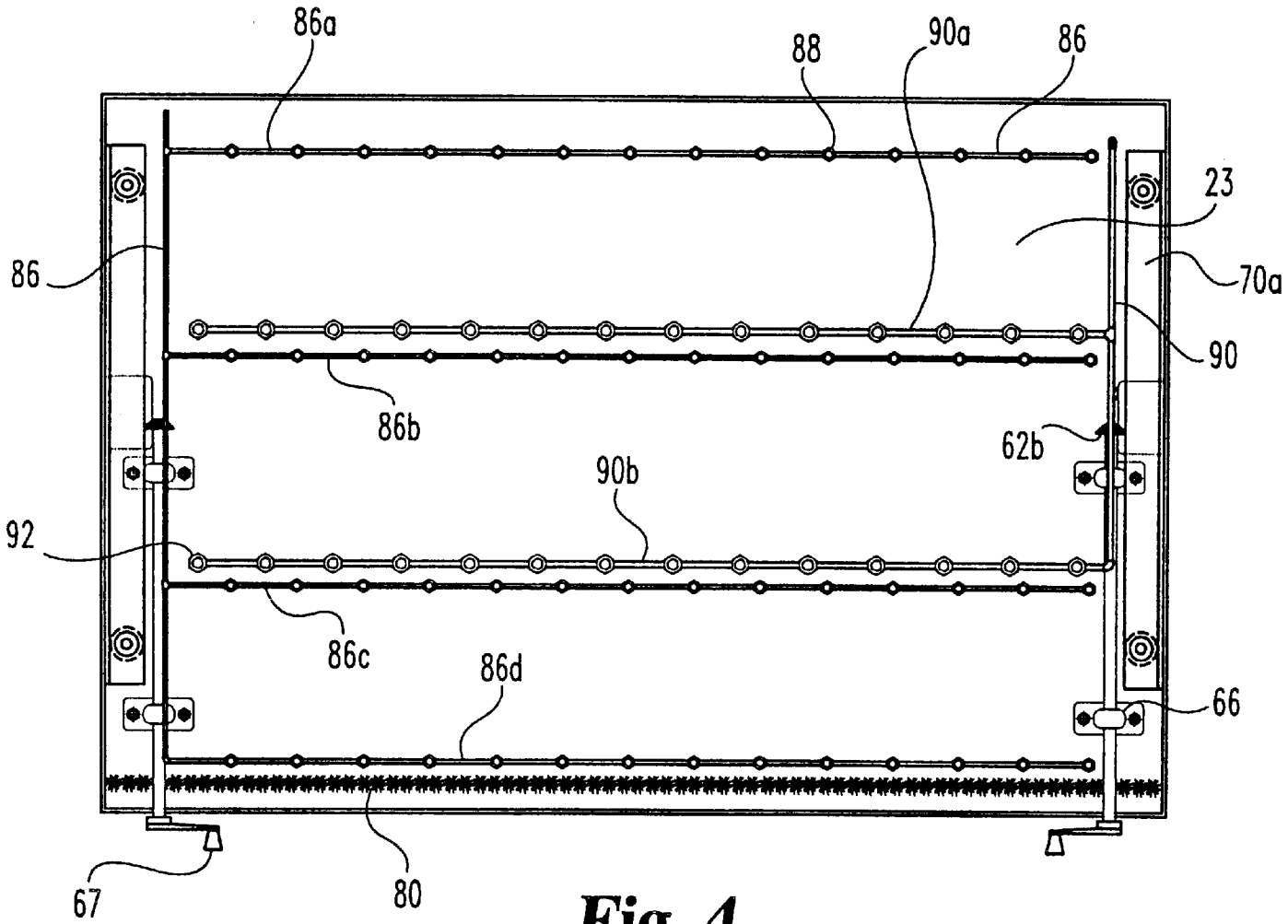
FIG. 4 is a cross-sectional view of the apparatus of FIG. 1 as taken along line 4—4 of FIG. 1.

An array of manifolds and nozzles suitable for directing flows of gas and/or liquid at shelf 48 are located within enclosure 22 near top 23 as seen in FIG. 4. A liquid manifold 86 comprised of tubing provides water or other cleaning liquid to a plurality of liquid spray nozzles 88. Nozzles 88 are arranged and constructed so as to provide a stream or a spray of high velocity liquid directed toward shelf 48. In one embodiment of the present invention, there are four branches 86*a*, 86*b*, 86*c* and 86*d*, within enclosure 22. The nozzles 88 on branches 86*a* and 86*d* are preferably oriented both downward and inward toward the center of enclosure 22. Some embodiments of the present invention also include a gas manifold 90 for directing a flow of gas such as air onto the shelf in the inner position. In one embodiment of the present invention, there are two branches 90*a* and 90*b* of air manifold 90, each with a plurality of gas blast nozzles 92. Nozzles 92 direct high velocity gas toward the object to be cleaned so as to help loosen and remove material on the object. In addition, gas from air blast nozzle 92 may be applied after washing the object with the cleaning liquid so as to gas dry the object. Gas exiting nozzles 92 flows out of enclosure 22 either through brush seal 80 or through screens 29 and does not build up pressure within enclosure 22.

Figure 7:
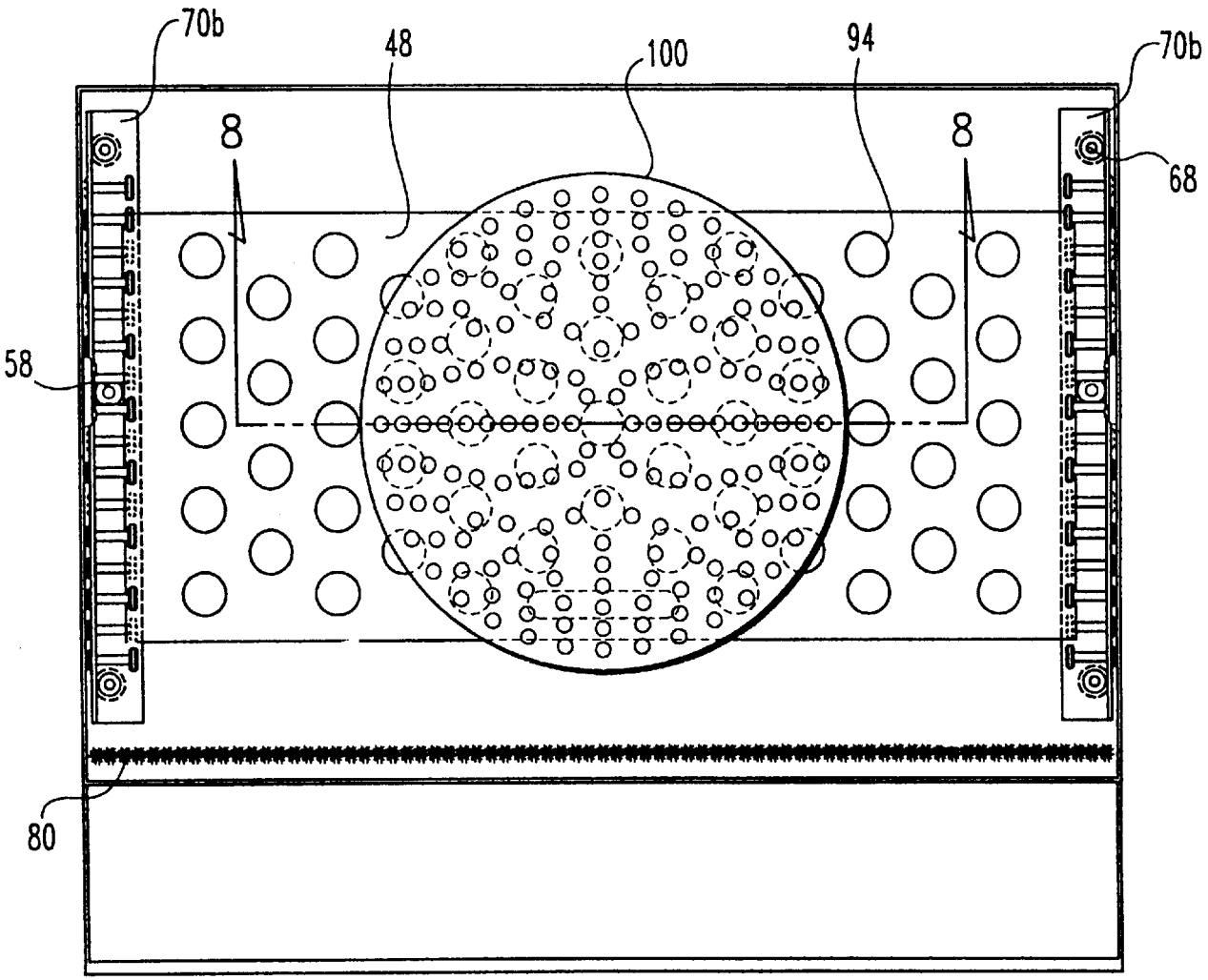
FIG. 7 is a cross-sectional view of an apparatus according to another embodiment of the present invention.
Figure 8:
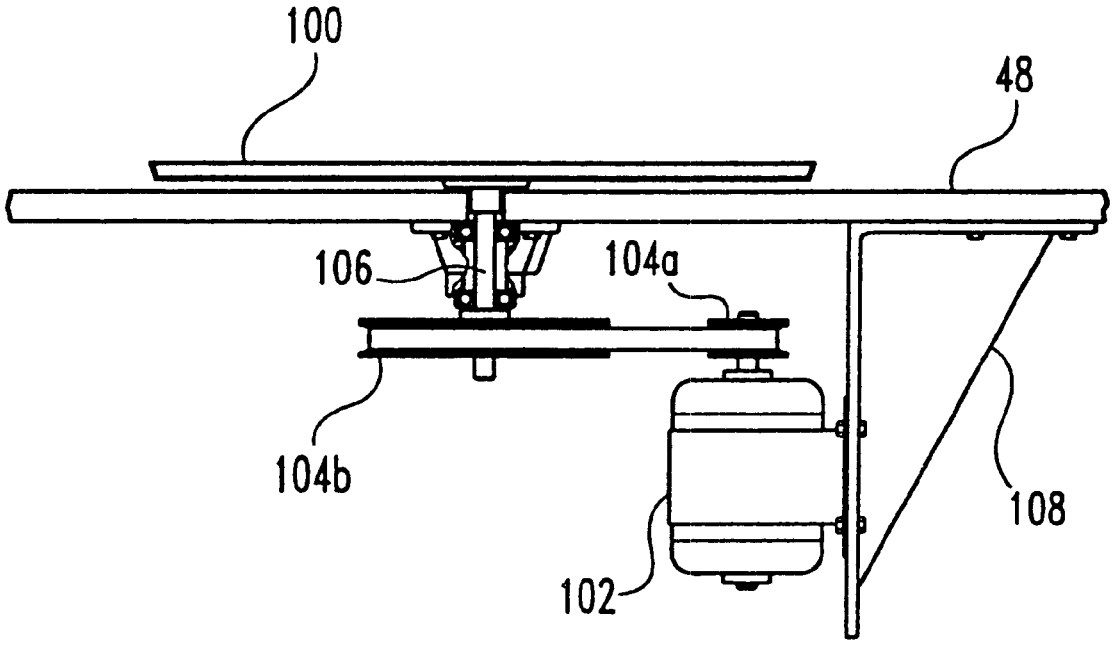
FIG. 8 is a partial cross-sectional view of the apparatus of FIG. 7 as taken along line 8—8 of FIG. 7.

In another embodiment of the present invention, objects to be cleaned are placed by an operator upon a rotating turntable 100. As seen in FIGS. 7 and 8, a turntable 100 is coupled to a motor 102 which rotates turntable 100 through a drive belt around a pair of pulleys 104*a* and 104*b*. Pulley 104*b* is coupled to turntable 100 by a shaft 106 which extends through and is bearingly supported by slidable shelf 48. Motor 102 is supported by a bracket 108 from shelf 48. Thus, turntable 100 and its driving mechanism is slidable into and out of enclosure 22.

Turntable 100 assists the drying of an object in several ways. For example, turntable 100 may be turned at a relatively slow rate during drying. Because of the rotation of the object within enclosure 22, it is possible to reduce the number of liquid spray nozzles 88 and/or gas blast nozzles 92 within workbench 20. By using fewer gas blast nozzles 92, the operational expense of providing air to workbench 20 is reduced because of the reduced flow of gas during drying. For example, one embodiment of the present invention contemplates about three gas blast nozzles 92 within enclosure 22, one located near the center of turntable 100, a second gas blast nozzle located near the circumference of turntable 100, and a third gas blast nozzle located outside of the circumference of turntable 100. Yet another embodiment of the present invention contemplates the rotation of turntable 100 at a higher speed, such that there is a removal of liquid from the object by a centrifuging effect. Drying during centrifuging may be enhanced by flow of gas through gas blast nozzles 92. Some embodiments of the present invention incorporate various tie-down features to help maintain the object on turntable 100 during rotation.

Figure 9:
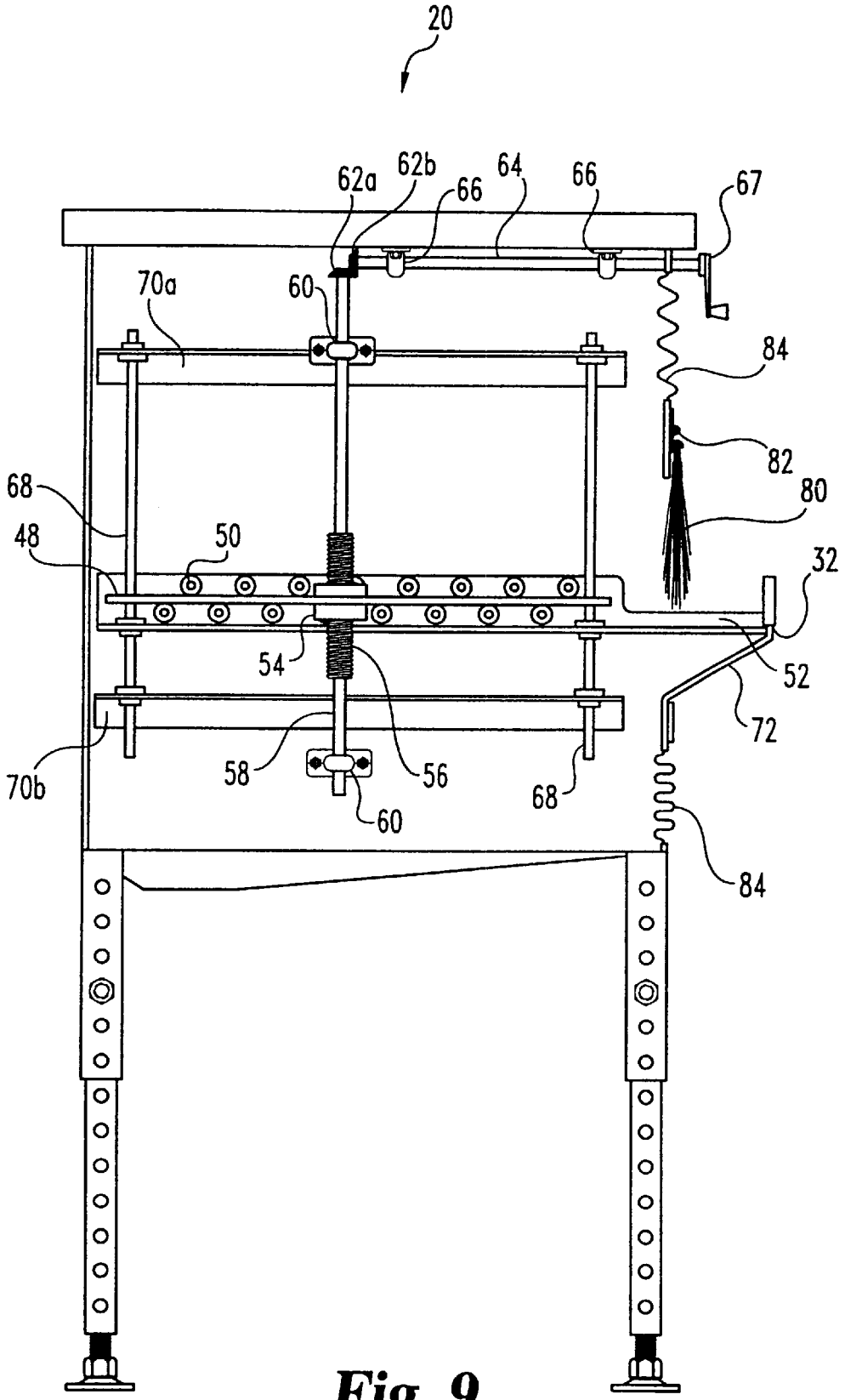
FIG. 9 is a cross-sectional view of an apparatus according to another embodiment of the present invention.

FIG. 9 depicts yet another embodiment of the present invention. In this embodiment, collector 32 may be raised and lowered with shelf 48. Preferably, shelf support 52 may be extended so as to attach to a portion of collector 32. Those of ordinary skill in the art will recognize other structure and methods for raising and lowering shelf 48 and collector 32. Thus, both shelf 48 and collector 32 may be placed at a height ergonomically suitable for the operator, and may also be placed at a height for optimum cleaning and drying of the object. In this embodiment, it is preferable that brush seal 80 be supported from a second spring-loaded bellows 84 that is guided by enclosure 22 (not shown).

While the invention has been illustrated and described in detail in the drawings and description, the same is to be considered as illustrative and not restrictive in character, it being understood that only preferred embodiments have been shown and described and that all changes and modifications that come within the spirit of the invention are desired to be protected. Various elements of different embodiments may be combined with other elements of other embodiments. For example, turntable 100 may be combined with the embodiment of FIG. 9.

What is claimed is:

1. An apparatus comprising:

an enclosure with a plurality of sides;

a table top for said enclosure, said table top being suitable for dimensional gaging of a machined object;

a rotatable turntable for supporting the machined object within said enclosure;

a motor for rotating said turntable; and at least one nozzle within said enclosure for providing a flow of gas or liquid at said turntable to clean the machined object.

2. The apparatus of claim 1 wherein one of said sides defines an opening, and further comprising a shelf for rotatably supporting said turntable, said shelf being slidable through the opening into said enclosure.

3. The apparatus of claim 2 wherein said shelf is slidable to an outer position, and which further comprises a collector on one side of said enclosure positioned to collect liquid from the machined object when said shelf is in the outer position and to direct the collected liquid to the bottom of the enclosure.

4. The apparatus of claim 3 which further comprises means for raising and lowering said collector within said enclosure.

5. The apparatus of claim 3 which further comprises means for raising and lowering said shelf within said enclosure.

6. The apparatus of claim 1 wherein one of said sides defines an opening, said turntable being slidable through the opening into said enclosure.

7. The apparatus of claim 6 which further comprises a plurality of nozzles within said enclosure for providing a flow of gas at said turntable to clean the object.

8. The apparatus of claim 7 which further comprises means for raising and lowering said turntable within said enclosure.

9. The apparatus of claim 8 wherein said turntable is slidable to an outer position, and which further comprises a collector on one side of said enclosure positioned to collect liquid from the machined object when said turntable is in the outer position and to direct the collected liquid to the bottom of the enclosure.

10. The apparatus of claim 1 wherein said turntable is slidable to an outer position, and which further comprises a collector on one side of said enclosure positioned to collect liquid from the machined object when said turntable is in the outer position and to direct the collected liquid to the bottom of the enclosure.

11. An apparatus comprising:

an enclosure with a plurality of sides;

a table top for said enclosure, said table top being suitable for dimensional gaging of a machined object;

a substantially horizontal shelf within said enclosure;

a turntable for supporting the machined object, said turntable being rotatably supported by said shelf; and at least one nozzle within said enclosure for providing a flow of gas or liquid at said turntable to clean the machined object.

12. The apparatus of claim 11 which further comprises means for raising and lowering said shelf within said enclosure.

13. The apparatus of claim 11 wherein said shelf is slidable within said enclosure.

14. The apparatus of claim 11 wherein said shelf is slidable to an outer position, and which further comprises a collector on one side of said enclosure positioned to collect liquid from the machined object when said shelf is in the outer position and to direct the collected liquid to the bottom of the enclosure.

15. The apparatus of claim 14 which further comprises means for raising and lowering said collector within said enclosure.

16. The apparatus of claim 11 which further comprises a plurality of nozzles within said enclosure for providing a flow of gas or liquid at said turntable to clean the object.

17. The apparatus of claim 11 wherein one of said sides defines an opening, and which further comprises a brush seal attached to the one of said sides, said brush seal at least partially obstructing a portion of the opening.

18. The apparatus of claim 11 wherein said shelf is slidable within said enclosure.

19. The apparatus of claim 18 wherein said shelf is slidable to an outer position, and which further comprises a collector on one side of said enclosure positioned to collect liquid from the machined object when said shelf is in the outer position and to direct the collected liquid to the bottom of the enclosure.

20. The apparatus of claim 19 which further comprises a plurality of nozzles within said enclosure for providing a flow of gas or liquid at said turntable to clean the object.

21. The apparatus of claim 20 which further comprises means for raising and lowering said collector within said enclosure.

* * * * *